US005477655A

United States Patent [19]

Hawley

[11] Patent Number: 5,477,655

[45] Date of Patent: Dec. 26, 1995

[54] AUTO-PRIMING CARTONER INFEED

[75] Inventor: Cory E. Hawley, Outing, Minn.

[73] Assignee: Riverwood International Corporation, Denver, Colo.

[21] Appl. No.: 205,274

[22] Filed: Mar. 1, 1994

[51] Int. Cl.[6] ..... B65B 35/30

[52] U.S. Cl. ..... 53/251; 53/497; 53/543; 53/566

[58] Field of Search ..... 53/251, 252, 250, 53/566, 564, 458, 543, 534, 531, 448, 443, 497, 496

[56] References Cited

U.S. PATENT DOCUMENTS

| | | | |
|---|---|---|---|
| 2,350,560 | 6/1944 | Kimball | 53/497 |
| 2,898,715 | 8/1959 | Cella | 53/497 |
| 3,305,072 | 2/1967 | Young | 53/497 |
| 3,694,993 | 10/1972 | East | 53/497 X |
| 3,778,959 | 12/1973 | Langen et al. | 53/543 |
| 4,768,329 | 9/1988 | Borrow | 53/543 |
| 5,070,992 | 12/1991 | Bonkowski | 53/543 X |
| 5,241,806 | 9/1993 | Ziegler et al. | 53/566 |

OTHER PUBLICATIONS

U.S. application Ser. No. 08/022,661 filed Mar. 1, 1994, to Ziegler.

*Primary Examiner*—James F. Coan

*Attorney, Agent, or Firm*—Joel D. Skinner, Jr.; Steve McLary

[57] ABSTRACT

An apparatus for controlling the input of articles to a packaging machine. The apparatus comprises a dead plate, a plurality of stop posts and an actuator connected to each stop post. The dead plate has top and bottom surfaces and a plurality of lanes located on the top surface and extending from a proximal edge to a distal edge, across which articles are moved, and at least one aperture disposed in each lane. Each stop post is aligned for extension through a corresponding dead plate aperture. An actuator is connected to each stop post, whereby the stop posts are extendible and retractable above the top surface of the dead plate, the stop posts impeding travel of articles across the dead plate when extended and permitting travel of articles across the dead plate when retracted.

22 Claims, 8 Drawing Sheets

22°
45°
100
107
113
114b
114c
114d
114e
115
116b
116c
116d
117
117f
118
119
120
132
133
134
135
136
137
138
139
17
18
20

AUTO-PRIMING CARTONER INFEED

BACKGROUND OF THE INVENTION

1. Field of the Invention

This invention relates to packaging apparatus and methods. Particularly, this invention relates to an infeed control apparatus and method for use with a continuous motion cartoner to load single or multiple layer groups of articles such as beverage cans into packages such as paperboard cartons or carriers. The infeed control apparatus and method of the present invention are useful for controlling the startup and shutdown of such packaging machines.

2. Background Information

In the past, various machines have been utilized to package a variety of product groups. Many of these machines operate continuously and at very high speeds once they are initially setup or configured. However, the initial start up of such machines is typically a slow process. Also, such machines must be periodically shut down for routine maintenance and in the event of a failure, for example due to product jamming. Shut down may also occur to make changes in the processed product or packages. After a shut down, the machine must be setup once again prior to restarting. During setup, machines must be primed with an initial load of product at their infeed end. This initial priming of infeed product is typically performed by hand and is a relatively slow process. The initial start up, shut down and restart procedures significantly reduce the overall speed and productivity of the machine over the course of its operative life. And, because such procedures are labor intensive they increase the overall cost of operating the machine.

In so far as is known, no apparatus or method has been developed or proposed which has solved the problem of accomplishing machine start up and shut down quickly, easily and automatically. In view of the limitations and shortcomings of prior art methods and apparatus, it is an object of this invention to provide an infeed mechanism for use with a continuous high speed packaging machine which minimizes setup time. Another object of this invention is to provide a mechanism which is fully adjustable for use with a variety of articles and article group types and sizes. A particular object of the invention is to provide an infeed mechanism which is self priming and automatically provides a full load of product at the infeed end so that the packaging machine is quickly setup and capable of being run at high speed. A final object of this invention is to provide an input mechanism which functions during the shut down phase of machine operation to improve startup phase operation.

SUMMARY OF THE INVENTION

The present invention provides an apparatus for controlling the input of articles to a packaging machine, comprising:

a) a dead plate having top and bottom surfaces, the dead plate further having a plurality of lanes located on the top surface and extending from a proximal edge to a distal edge; across which articles are moved, and at least one aperture disposed in each lane;

b) a plurality of stop posts, each stop post being aligned for extension through a corresponding dead plate aperture; and c) means to move the stop posts, whereby they are extendible and retractable above the top surface of the dead plate, the stop posts impeding travel of articles across the dead plate when extended and permitting travel of articles across the dead plate when retracted.

In a preferred embodiment, the invention provides an article infeed mechanism for use with a packaging machine, comprising:

a) at least one article infeed line supplying a stream of articles, the article infeed line having a conveyor and a plurality of guides disposed above the conveyor and which define a plurality of article transport lanes;

b) an article group selection and transport line intersecting the article infeed line at a predetermined angle, the article group selection and transport line having a conveyor and a plurality of spaced flight bars fixed on the conveyor, the flight bars raking articles from the article infeed line to form article groups of a predetermined pattern which are transported in a linear direction by the conveyor subsequent to formation; and c) and automatic priming mechanism useable on startup of the packaging machine to establish completed article groups on the article group selection and transport line, the automatic priming mechanism comprising:

i) a dead plate having top and bottom surfaces, the dead plate being disposed at an interface between the article infeed line conveyor and the article group selection and transport conveyor, the proximal edge of the dead plate abutting the infeed conveyor and the distal edge abutting the selection and transport conveyor, the dead plate further having a plurality of lanes located on the top surface and extending from a proximal edge to a distal edge, across which articles are moved, and at least one aperture disposed in each the lane;

ii) a plurality of stop posts, each stop post being aligned for extension through a corresponding dead plate aperture; and iii) means to move the stop posts, whereby they are extendible and retractable above the top surface of the dead plate, the stop posts impeding travel of articles across the dead plate when extended and permitting travel of articles across the dead plate when retracted.

The benefits of this invention will become clear from the following description by reference to the drawings.

DESCRIPTION OF THE PREFERRED EMBODIMENT

The apparatus and methods of the present invention are for controlling the input of articles at the infeed end of a high speed, continuous packaging machine 10. The apparatus and methods improve the start-up and shut down procedures for the machine 10. The apparatus may be modified or adjusted to provide reliable infeed control of articles or products of varying types, sizes and quantities. In the example embodiment, the machine 10 loads standard twelve ounce beverage cans into 24(12/12), 30(15/15) and 36(18/18) pack stacked paperboard packages or carriers However, the apparatus and method of this invention may also be used with many other types of packaging machines to process a variety of types and sizes of articles, article groups and packages. It is specifically within the purview of this invention that the apparatus and methods be useable to control the infeed of articles in a packaging machine that processes single level or unstacked article groups. One such machine is the Continuous Motion Cartoner Assembly disclosed in U.S. Pat. No. 5,241,806, which is incorporated by reference herein.

Figure 1:
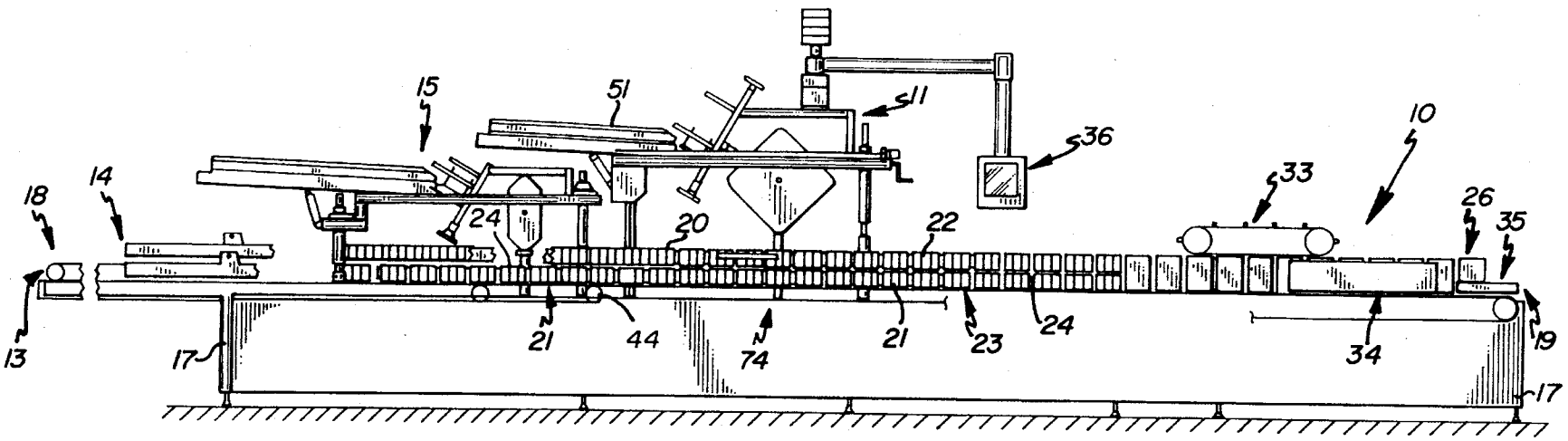
FIG. 1 is a side view of an apparatus for continuously forming article groups and side loading the groups into packages which utilizes the auto-priming infeed mechanism of the present invention.
Figure 2:
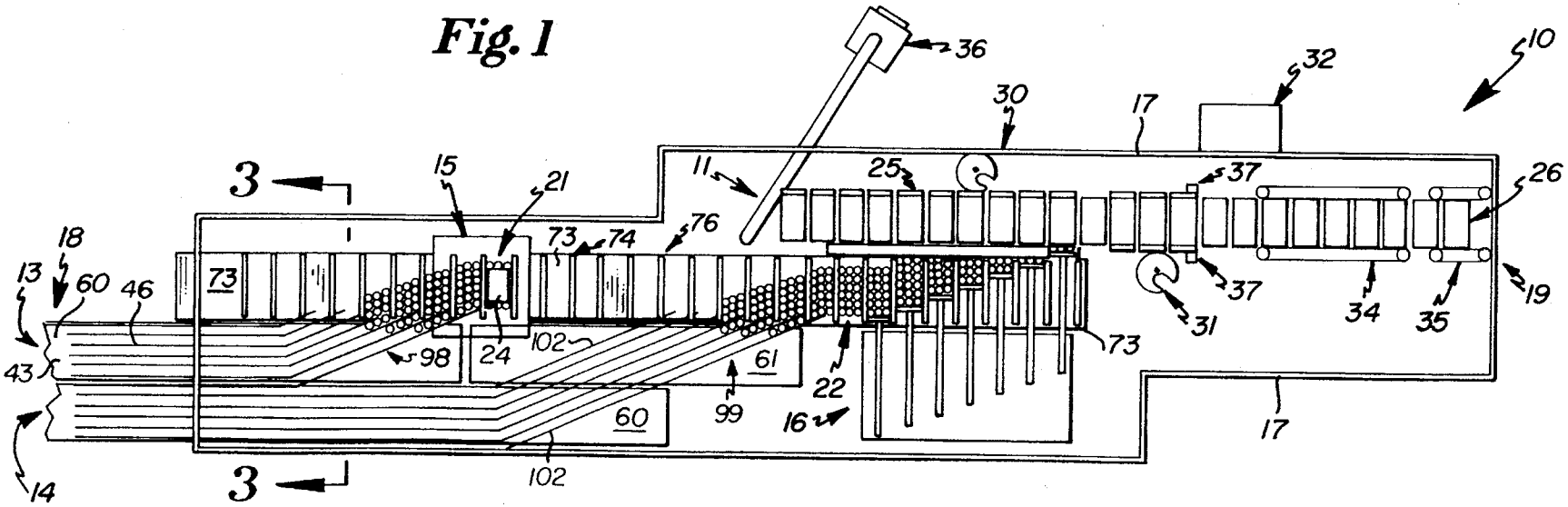
FIG. 2 is a plan view of the apparatus shown in FIG. 1.

Referring to FIGS. 1 and 2, the continuous motion cartoner assembly 10 generally comprises a carton supply and transport mechanism 11, an article group selection and transport mechanism 12, a pair of article supply mechanisms 13 and 14, a pair of infeed control mechanisms 98 and 99, a divider sheet placement mechanism 15, and a cross loading mechanism 16. These mechanisms are shown to be supported by a unitary frame structure 17. With the exception of the infeed control mechanisms 98 and 99, the movement of each mechanism is synchronized with one another, for example by a common drive and/or gearing means controlled from a control station 36. The synchronized operation of these cooperating mechanisms 12–16 continuously selects and meters streams of individual articles 20 traveling in two input streams into predetermined stacked groups 23 traveling in a second stream, which are subsequently transversely loaded into cartons 25 traveling in a third parallel stream. Ancillary packaging mechanisms such as flap folders 30 and 31, glue stations 37 and 32, and top and side compression mechanisms 33, 34 and 35 are shown disposed downstream to form the completed package 26.

The carton supply mechanism 11 is shown to be disposed proximate an input end 18 of the assembly 10. Canon blanks 25 are setup and transported in a linear fashion to an output end 19 of the apparatus 10. The article supply mechanisms 13 and 14 are also shown to be disposed at the input end 18 of the apparatus 10. A first portion of each article supply mechanism 13 and 14 is disposed spatially parallel to the article group selection and transport mechanism 12, and a second portion merges, at a preferred angle of 22.5 degrees, with the article group selection transport mechanism 12 to supply streams of product or articles 20 to two separate positions along the article group selection and transport mechanism 12. These merging mechanisms 12–14 are further constructed and arranged to meter individual articles 20, via a fixed flight bar arrangement, into predetermined stacked article groups 21 and 22 on the mechanism 12. The low and high infeed control mechanisms 98 and 99 operate at the start-up phase of operation of the apparatus 10 to provide automatic priming of complete article groups 21 and 22 on the selection and transport mechanism 12, at the respective transport mechanisms 13 and 14. Apparatus 10 start-up occurs periodically for routine maintenance, product or packaging change over, and for example in the event of a machine jamming due to defective articles. The infeed control mechanisms 98 and 99 enable faster start-up of the machine 10 by fewer personnel than would otherwise be possible with prior art start-up techniques.

The stacking function of the device 10 is accomplished by forming a first group 21 at a low level, placing a separator or divider sheet 24 on the lower group 21 via the divider sheet placement mechanism 15, and then simultaneously forming a second group 22 downstream at a higher level and allowing the upper group 22 to slide across the divider sheet 24 by the action of me flight bars of the article group selecting mechanism 12. The article group selection and transport mechanism 12 is disposed adjacent and parallel to the carton supply and transport mechanism 11 and extends downstream, in a linear orientation. Merged or combined article groups 23 are transported downstream thereon in a spaced and metered fashion, each group 23 being aligned with a carton 25 traveling on the carton supply and transport mechanism 11.

The crossloading mechanism 16 is disposed adjacent to and parallel with the second portion of the article group selection and transport mechanism 12, extending and traveling longitudinally with respect to the apparatus 10. The crossloading mechanism 16 has a plurality of loading arms which extend transversely or perpendicularly with respect to the transport mechanisms 11, 13 and 14, to move product groups 23 on the article group selection transport mechanism 12 into the ends of aligned cartons 25 traveling on the carton transport mechanism 11, thereby loading the cartons 25 with product groups 23.

Figure 3:
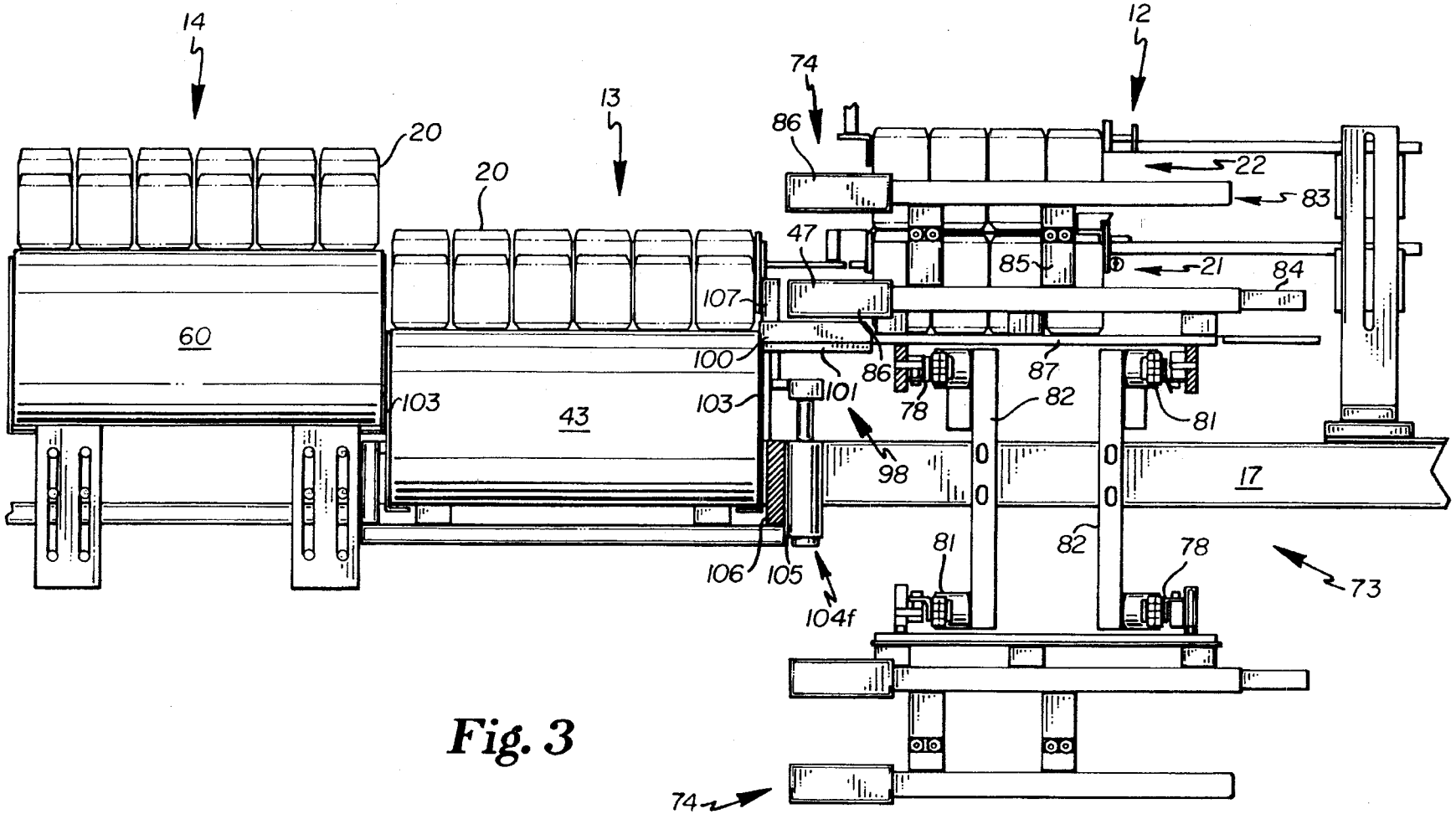
FIG. 3 is a sectional view of the apparatus taken along line 3—3 of FIG. 2.
Figure 4:
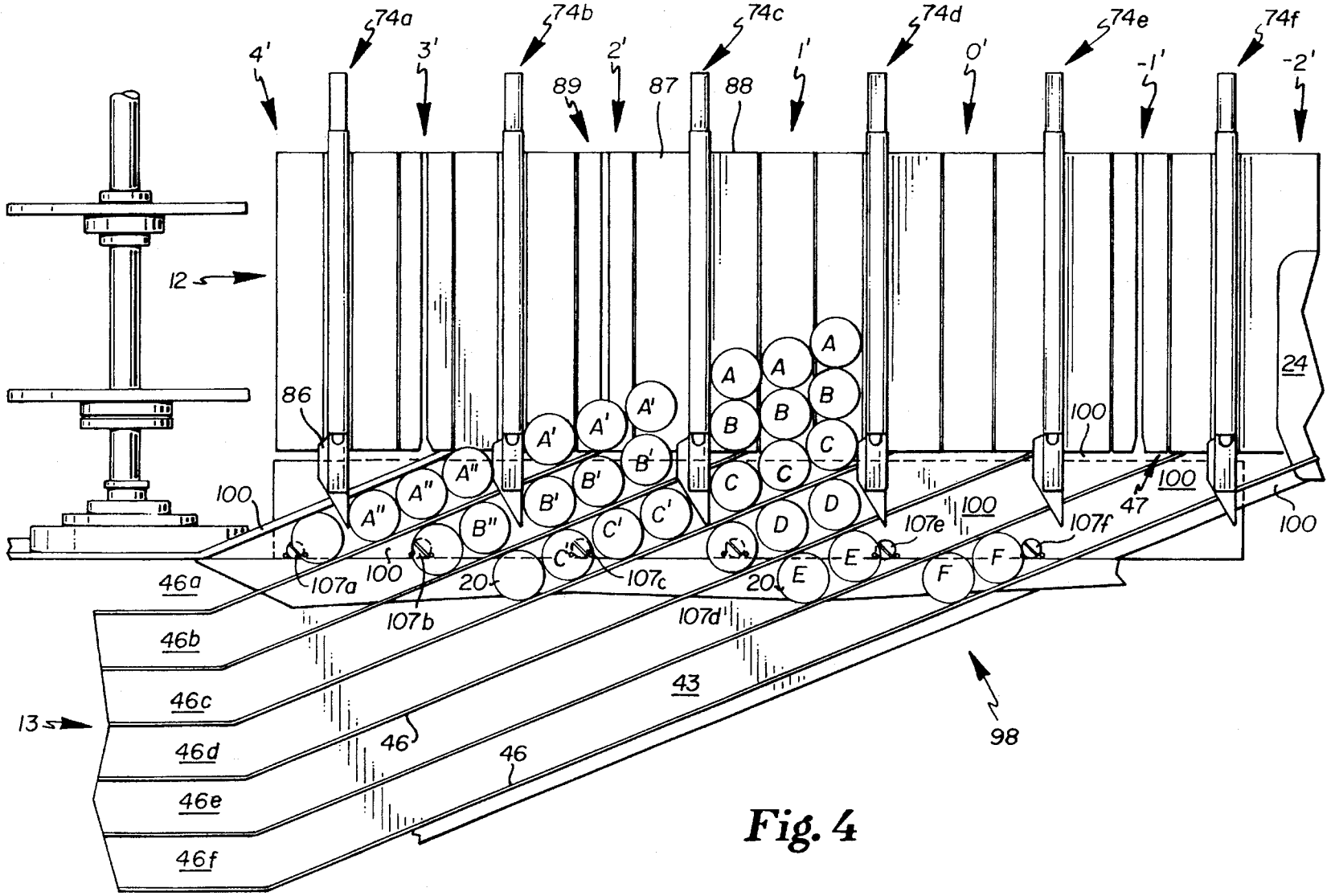
FIG. 4 is a top view of the first or lower infeed section of the apparatus.

Referring also to FIGS. 3 and 4, the first or low article supply mechanism 13 provides a plurality of input individual articles 20 to the apparatus 10 at a first predetermined level or height and at a first point on the article group selection and transport mechanism 12. The mechanism 13 is shown to comprise a conveyor 43 disposed about a drive sprocket/shaft assembly 44 and an idler sprocket/shaft assembly (not shown). Articles 20 transported on the top, forward run of the conveyor 43 are separated into a plurality of single file paths by lane separators 46. The lane separators 46 are preferably upstanding plates, alternatively rails, of a height sufficient to guide the flow of one or more containers 20 on the Conveyor 43, and which are suspended above the conveyor 43. The lane separators 46 form product conveyance lanes which angle towards the article group selection and conveyance mechanism 12. Each lane separator 46 has a terminal portion 47 of a predetermined length, such that it extends a predetermined distance into the path of the article group selection and transport mechanism 12. Each terminal portion 47 is constructed such that it allows longitudinally transported flight structures 74 (described further below) of the article group selection and transport mechanism 12 to pass through the angled conveyance lanes. As the flight bars 74 mesh with the lane separator end portions 47, they engage articles 20 disposed in lanes and rake them onto the longitudinal conveyance path of the mechanism 12 and between adjacent flight bars 74.

Once fully primed with a load of articles 20, the combination of forces exerted by the flight bars 74, lane ends 47, and conveyors 43 and 12 serve to select and meter individual articles 20 into article groups 21 of a predetermined size and configuration which are fully merged onto the article group selection and transport mechanism 12 and disposed between adjacent flight bars. The size, orientation and dimensions of the resultant product groups 21 is dependent Upon the number of infeed lanes, product dimensions, and the configuration and spacing of the flight bars 74. For example, in the instant embodiment, six (6) lanes of product are active, and the flight bars 74 are spaced such that the resultant low product group 21 is selected of eighteen (18) articles in three rows of six cans each. Lanes may be blocked off by closure means (not shown) to alter the group 21 size and/or orientation. The lane separators 46 and the flight bars 74 are adjustable to provide full variability of product group parameters.

Figure 8:
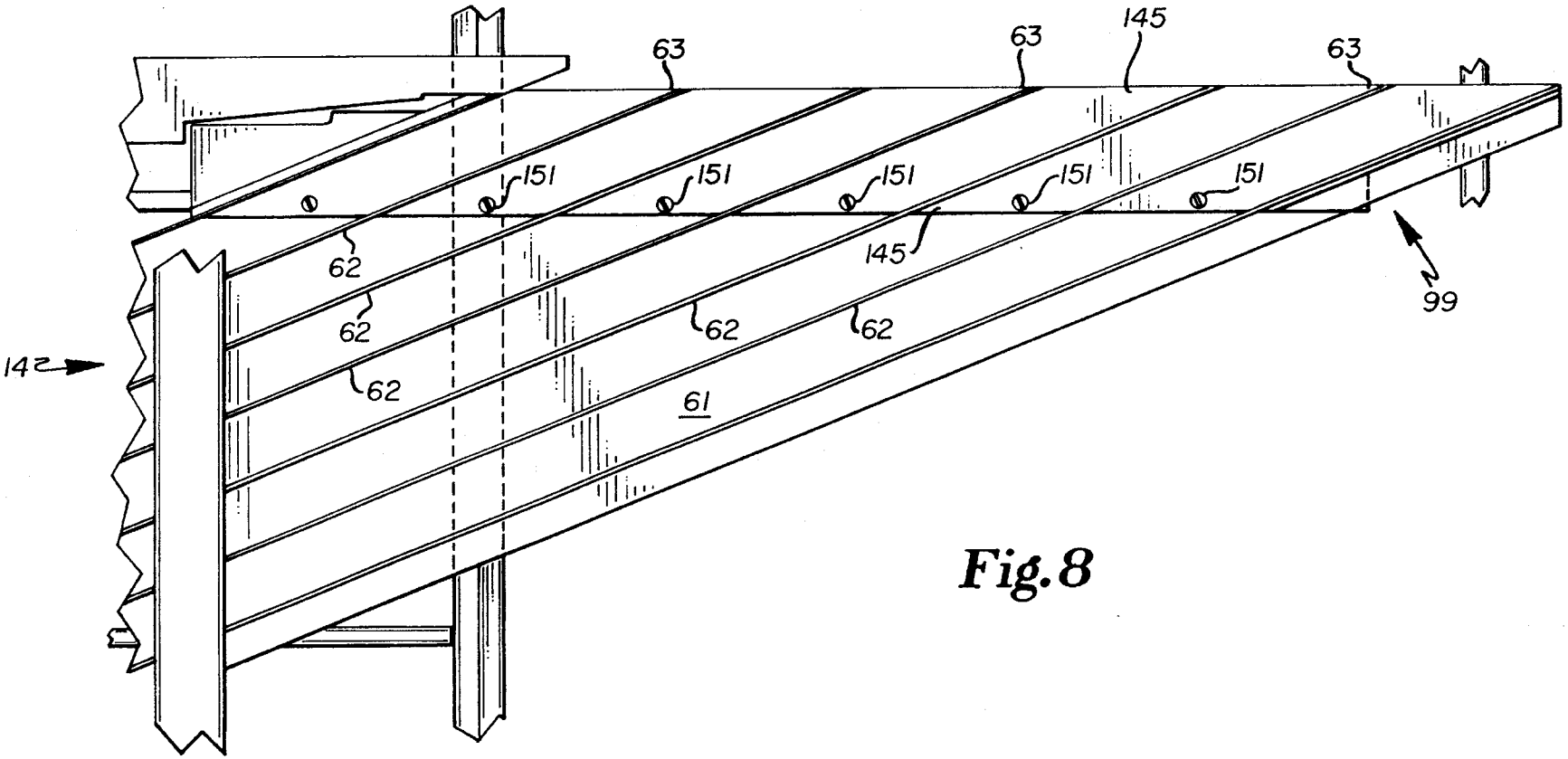
FIG. 8 is a top view of the second or upper infeed section of the apparatus.
Figure 11:
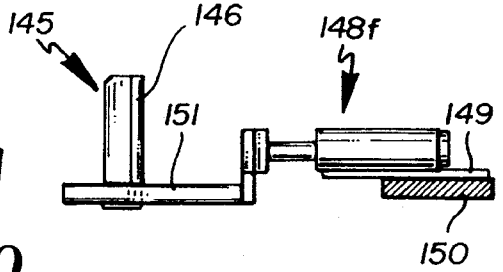
FIG. 11 is an end view of the mechanism.
Figure 9:
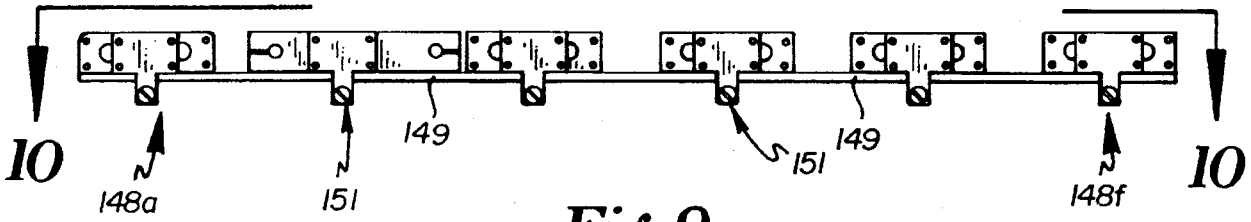
FIG. 9 is a top view of the auto-priming infeed mechanism operative on the second infeed section.
Figure 12:
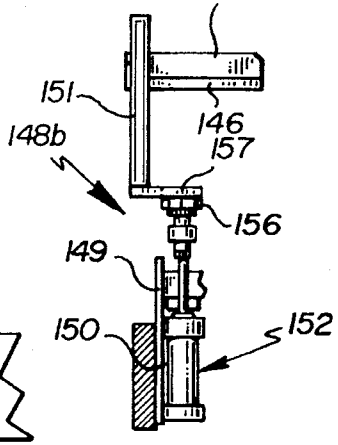
FIG. 12 is a sectional view of the mechanism taken along line 12—12 of FIG. 10.
Figure 10:
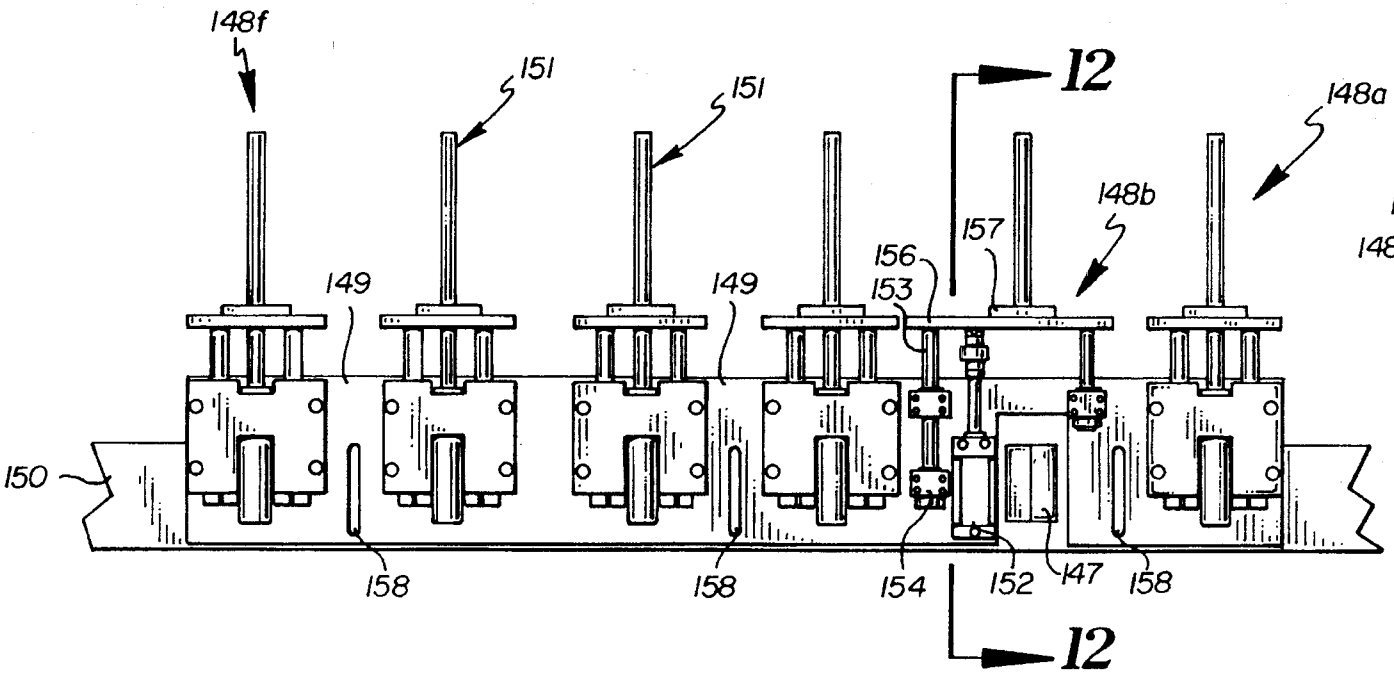
FIG. 10 is a side view of the mechanism.

Referring also to FIG. 8, the second or high article supply mechanism 14 provides a plurality of input individual articles 20 to the apparatus 10 at a second predetermined level or height and at a predetermined point downstream from the low article supply mechanism 13. The mechanism 14 is also comprises a pair of conveyors 60 and 61, each being disposed about a drive sprocket/shaft assembly and an idler sprocket/shaft assembly. The conveyors 60 and 61 may consist of a plurality of individual tracks or paths or alternatively a unitary, wider path or belt. Articles 20 transported on the top, forward run of the conveyors 60 and 61 are separated into a plurality of single file paths by lane separators 62. The lane separators 62 form product conveyance lanes which angle towards the article group selection find conveyance mechanism 12 at an approach angle of approximately 20–25 degrees with respect to the longitudinal axis of the mechanism 12. The conveyors 60 and 61 are disposed parallel with the article group selection and transport conveyor 12. Conveyor 61 is further disposed immediately adjacent the article group selection and transport conveyor 12 to allow for article 20 movement thereinbetween. Each lane separator 62 has a terminal portion 63 that allows the flight bars 74 to rake articles therefrom.

Referring also to FIGS. 3, 4, 8, 13 and 14, the article group selection and transport mechanism 12 selects article groups 21 and 22 from the first or low article supply mechanism 13 and from the second or high article supply mechanism 19, and transports them linearly downstream with respect to the overall apparatus 10. The downstream transport of article groups 21 and 22 is synchronized with the carton supply and transport mechanism 11 and with the crossloading mechanism 16 to effectuate carton 25 loading. The article group selection and transport mechanism 12 generally comprises a conveyor 73, a plurality of flight bar assemblies 74 fixed to and longitudinally transported on the conveyor 73, and a plurality of slide plates 75, which are disposed on the conveyor 73 between the spaced flight bars 74.

The conveyor 73 runs at a predetermined speed and includes drive and idler sprocket/shaft assemblies 76 and 77, a pair of parallel endless conveyor chains 78 which are connected to and revolve about the sprocket/shaft assemblies, forming a longitudinally extending forward or top run and a return or bottom run. The conveyor chains 78 are each supported by top and bottom longitudinally extending chain guides 81, which in turn are connected to the main frame 17 via upstanding conveyor supports 82.

Figure 13:
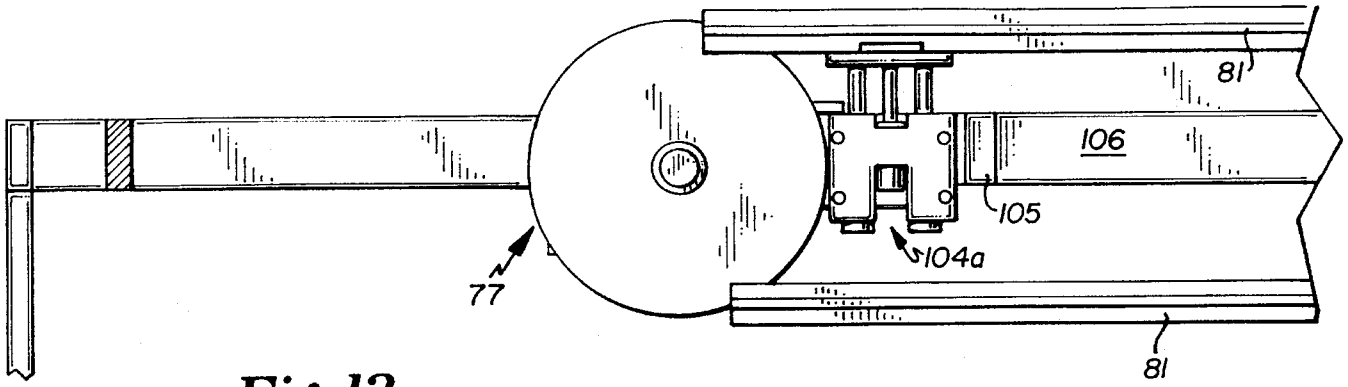
FIG. 13 is a side view of a portion of the infeed end of the apparatus.
Figure 14:
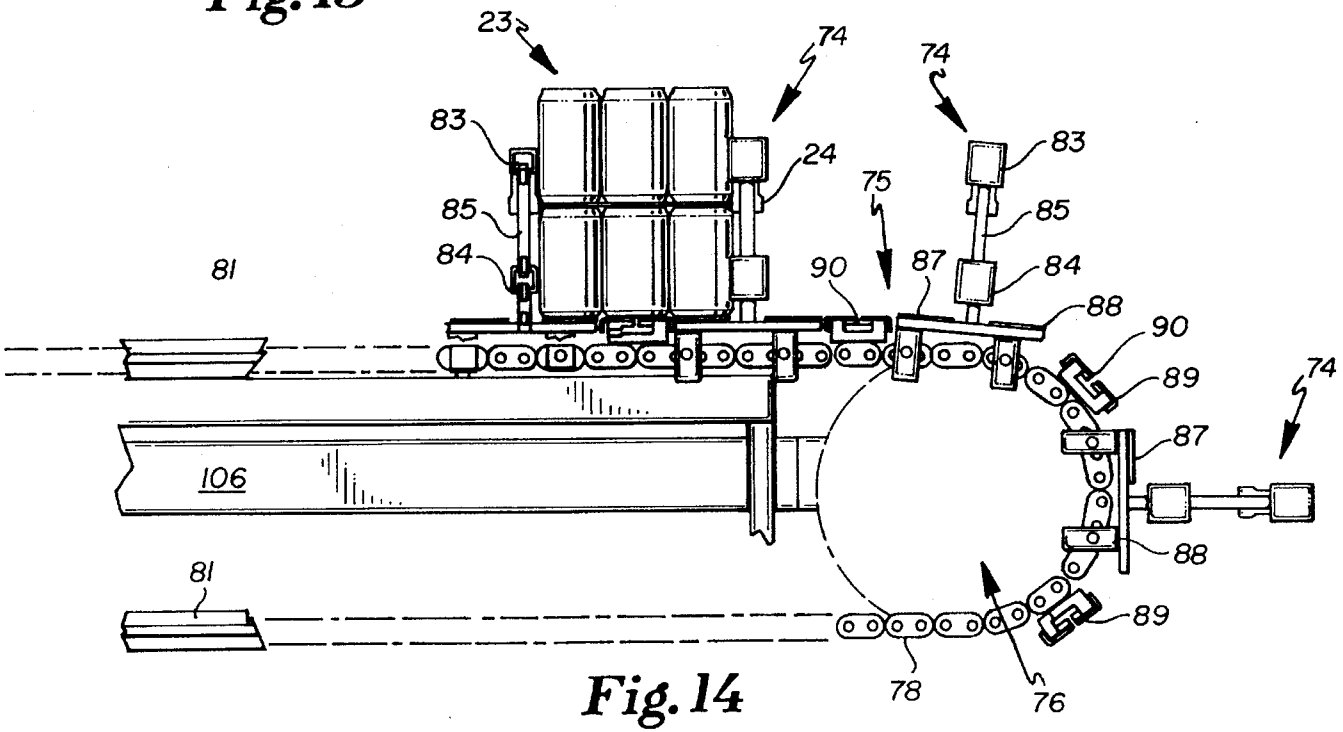
FIG. 14 is a side view of a portion of the output end of the apparatus.

As is best shown in FIGS. 3, 13 and 14, the flight bar assemblies 74 are each shown to include a top rail member 83 and a bottom rail member 84 which are connected to one another by vertical spacers 85. The top and bottom members 83 and 84 are shown disposed parallel to one another and spatially separated by the spacers 85. Each top and bottom member 83 and 84 further has an angled front end 86 and an elongated, rectilinear body terminating in a flat back end. The front end 86 slants or angles inwardly from its leading edge to its trailing edge to enable the flight bars 74 to select individual articles 20 disposed in the article infeed lanes and to separate them from the closely spaced nearest upstream article 20. A pair of fixed slide plates 87 and 88 are connected to each flight bar 74 assembly. Both the flight bars 74 and the slide plates 87 and 88 are connected to the flight chains 78 via connection brackets 86. The slide plates 87 and 88 are thin, flat structures with a low friction top surface which support the lower article groups 21 and further permit sliding movement thereon. Additionally, slotted slide plates 89 are disposed between adjacent flight bar assemblies 74. The height of the flight bar 74 (i.e., the separation distance between the top and bottom members 83 and 84) is a function of the container and container group size and configuration. The width of the top and bottom members 83 and 84 is a function of the desired dimensions of the product groups 21 and 22 formed.

Referring to FIG. 3, the low infeed control mechanism 98 basically comprises a dead plate 100 disposed at the interface between the low article supply mechanism 13 and the article group selection and transport mechanism 12, and a plurality actuators 104 *a–f* which are disposed below the deadplate 100 and have can stops 107 which are extendible through the deadplate 100 to either permit or impede movement of cans 20 from the article supply 13 across the deadplate 100 and onto the selection and transport mechanism 12. Referring also to FIG. 4, the deadplate 100 is oriented longitudinally and parallel to the selection and transport mechanism 12. The deadplate 100 is closely spaced from each of the conveyors 43 and 73 so that the ends 47 and 86 of the guides 46 and flight bars 74, respectively, travel over its top surface. The deadplate 100 supports the bottoms of the cans 20 during the period of travel from the conveyor 43 to the conveyor 73. The deadplate 100 is bolted to a metal deadplate mount 101 located below it. The mount 101 reduces the tendency of the deadplate 100 to expand and contract. The mount 101 is connected to and supported by brackets 102 which are connected to the conveyor 13 sideplate 103. The actuators 104 are disposed side by side in a linear orientation and aligned longitudinally with respect to the selection and transport mechanism 12. The actuators 104 are connected to a rigid elongated rail 105, which is connected to frame member 106.

Figures 15, 16, 17, 18, 19, 20, 21, 22, 23:
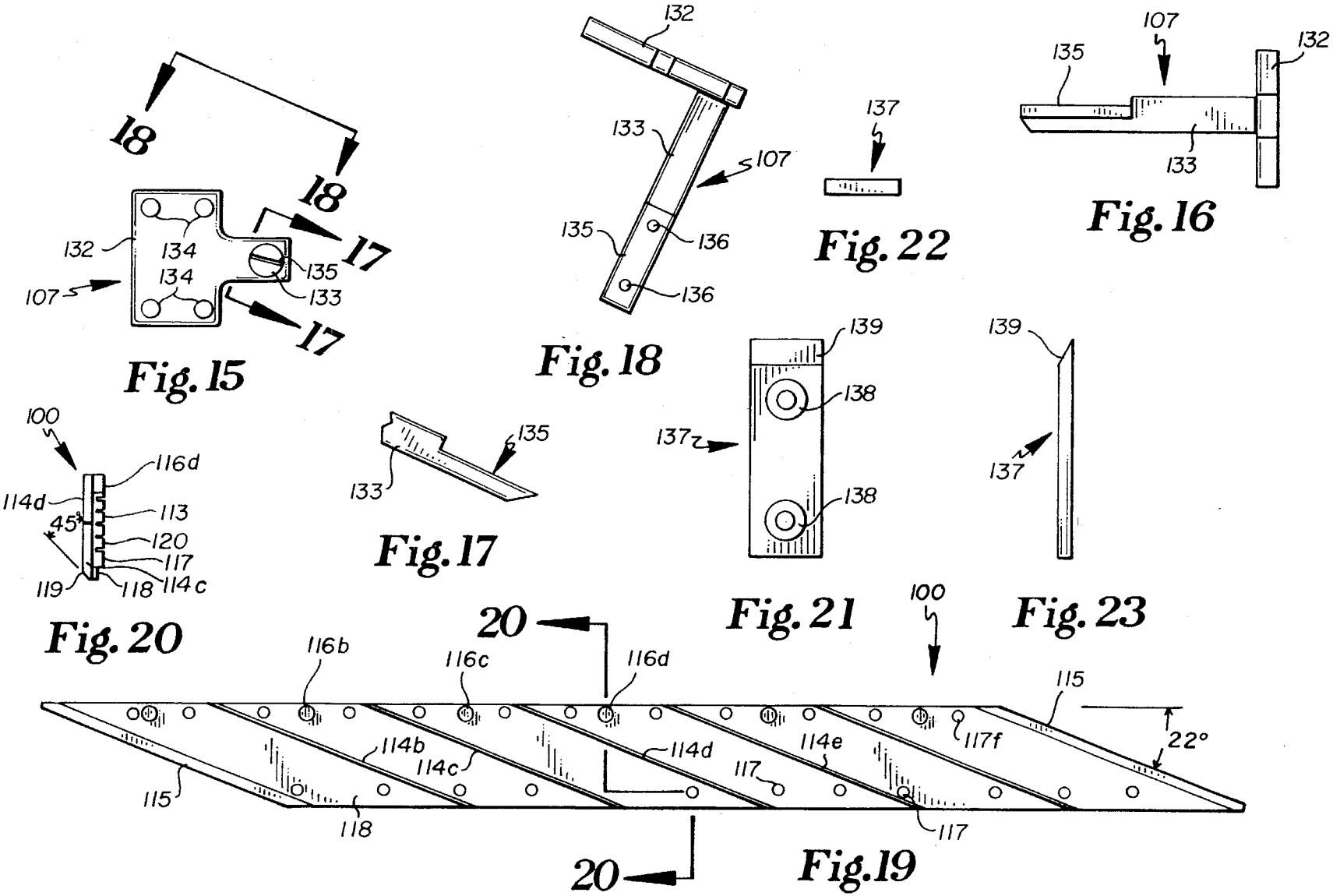
FIG. 15 is a top view of the can stop assembly of the mechanism.
FIG. 16 is a side view of the assembly.
FIG. 17 is a sectional view of the assembly.
FIG. 18 is another side view of the assembly.
FIG. 19 is a top view of the deadplate of the mechanism.
FIG. 20 is a crossectional view of the dead plate taken along line 20—20 of FIG. 19.
FIG. 21 is a front view of a wear pad used with the can stop assembly.
FIG. 22 is an end view of the wear pad.
FIG. 23 is a side view of the wear pad.

Referring to FIGS. 19 and 20, the deadplate 100 has a generally elongated body 113 which has the shape of a parallelogram. The body 113 is preferably constructed of UHMW to provide a low friction surface across which the cans 20 are transported. A plurality of spaced apart lane ridges 114 are formed in the top surface of the body 113 and define a plurality of can travel lanes of a predetermined width. The lane ridges 114 are oriented at an angle, with respect to the longitudinal axis of the body 113, corresponding to that of the infeed guides 46 (preferably 22.5°). An angled end wall 115 is disposed at each end of the body 113. Each can stop aperture 116 is disposed in each lane near the proximal or entry edge of the body 113. Each can stop aperture 116 is preferably disposed equidistant from its respective lane ridges 114 where the processed articles are cylindrical objects such as beverage cans. The can stop apertures 116 extend though the body 113 and permit extension of the can stops 107 therethrough. A plurality of bolt apertures 117 are spaced apart near the proximal and distal or egress edges of the body 113 to permit the deadplate 100 to be secured to the mount 101. The distal edge of the deadplate 100 has a beveled cut 119 on its top side. The cut 119 is at an angle of approximately 45 degrees with respect to a horizontal axis. The cut 119 extends through the land ridges 114. The bottom side of the distal edge of the deadplate 100 is notched 118. A plurality of thin, spaced lengthwise cuts 120 are located on the bottom surface of the body 113.

Figure 6:
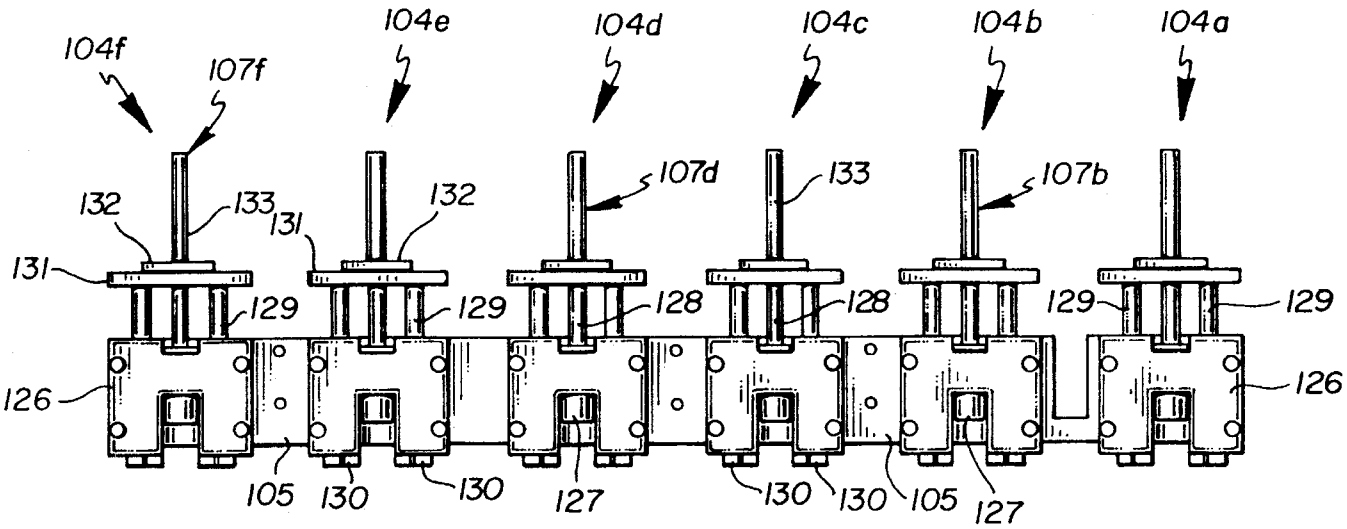
FIG. 6 is a side view of the mechanism.
Figure 7:
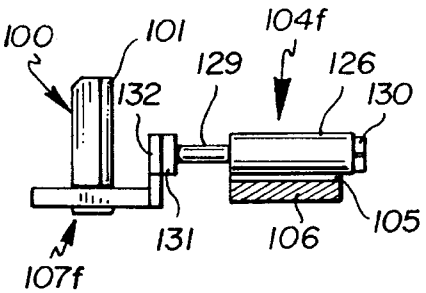
FIG. 7 is an end view of the mechanism.
Figure 5:
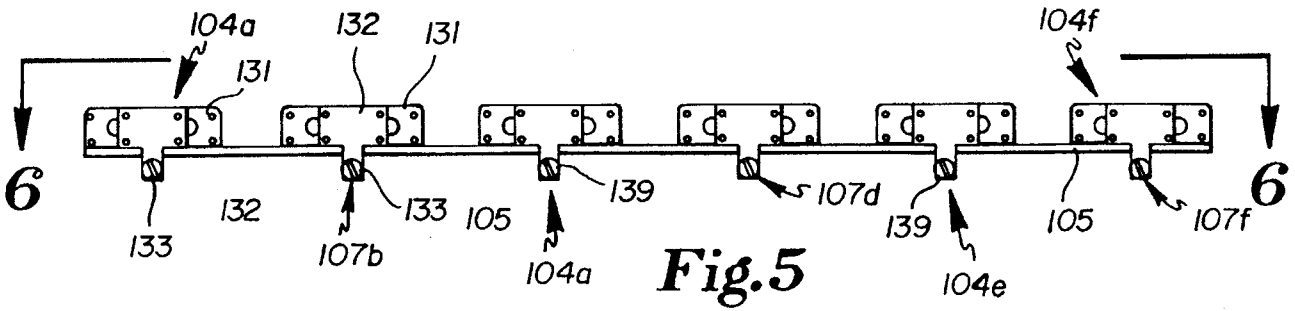
FIG. 5 is a top view of the auto-priming infeed mechanism operative on the first infeed section.

Referring to FIGS. 5–7, each actuator 104 basically comprises a Tolomatic H-block 126 (including an air cylinder 127, a piston shaft 128, a pair of guide or stabilizer shafts 129, and a pair of clamp collars 130), a first plate 131, a second plate 132, and a can stop shaft 133. The block body 126 is a bearing block of a predetermined configuration which is bolted to the rail 105. The approximately 80 psi air cylinder 127 is disposed in the center of the block 126 and the piston shaft 128 is extendible vertically upwardly therefrom in response to air pressure in the cylinder 127. Air lines (not shown) are connected to the bottom of each air cylinder 127 and are communicatively connected to a pneumatic control mechanism which controls the actuation of the air cylinders 127. Although the actuators 104 are shown in this example to be pneumatically controlled, electrically or mechanically controlled actuators may be substituted consistent with the basic teachings of the invention. The stabilizer shafts 129 are disposed to the sides of the air cylinder 127 and mounted in the block 126. The top ends of the piston shaft 128 and the two stabilizer shafts 129 are connected to the first plate 131, which is a rectangular, slightly elongated metal plate. The extension length or reach of the shafts 128 and 129 are controlled by the position of the stop clamps 130 on the shaft 129 bottom ends. The second plate 132 is connected to the first plate 131 and serves as a base for the can stop shaft 133.

Referring also to FIGS 15–18 and 21–23, the can stop shaft 133 is a stainless steel cylindrical rod of a predetermined length. The shaft 133 is connected at its base to the second plate 132, for example by welding. Apertures 134 are shown in the second plate 132 for mounting to the first plate 131 via bolts or screws. A notch 135 is disposed at the top of the shaft 133 for mounting of a wear pad 137. The wear pad 137 is constructed of UHMW and has dimensions which correspond to those of the notch 135. The wear pad 137 has a beveled top end 139 which permits reliable separation of closely spaced cans 20 traveling in the infeed lanes 46 when the can stops 107 are actuated and upwardly extended. Screw apertures 138 in the wear pad 137 correspond to securement apertures 136 in the shaft 133.

Several key principles exist with respect to the functionality of the apparatus 10, and particularly with respect to the infeed of cans 20 and their selection and formation into article groups 21 and 22. As is best shown in FIGS. 3 and 4, cans 20 advance toward the article selection and transport conveyor 12 by force supplied by the underlying conveyer 43 of the infeed line 13. Cans 20 advance across the proximal edge of the deadplate 100 under pressure from the upstream cans located on the conveyer 43. Thereafter, they are conveyed across the dead plate 100 and over its distal edge under the control of the flight bars 74. The leading edges of the flight bar ends 86 mesh with and pass through the slotted lane ends 47, and rake a predetermined number of cans 20, in this example three, therefrom. Cans 20 located immediately upstream of the raked or selected cans follow the trailing edge of the flight bar ends 86 until they are in a position to be raked by the leading edge of the next upstream flight bar end 86. Once the apparatus is primed with at least one complete product group 21 downstream of the raking zone shown in FIG. 4, and with product groups in intermediate phases of assembly, and with a full supply of infeed cans in each active infeed lane, the article selection and transport mechanism 12 will continuously form and transport completed groups 21. As was previously mentioned priming has heretofore been accomplished manually. Aside from the obvious limitations of this technique with respect to lack of speed and requirement for personnel involvement, manual start up often results in the formation of incompletely formed groups which must be removed downstream of the raking zone resulting in further time expended and waste of product and/or packaging material.

The infeed control mechanism 98 operates by initially impeding the flow of cans from all of the infeed lanes **46*a–f*. As the article group selection and transport mechanism 12 operates, it is cleaned out of all incomplete groups. Cans are prevented from entering the raking zone by the can stops 107*a–f*, which are initially fully upwardly extended. The conveyor 43 is operative, but the terminal or downstream can 20 in each lane is stopped by the stops 107*a–f*. This causes the forward or downstream progress of all of the upstream cans to be impeded as the conveyor 43 slides beneath them. The post 107 position in the middle of each lane 46*a–f* and adjacent the proximal edge of the deadplate 100 has been found to provide best performance for beverage cans. Additionally, the beveled edge at the top of each post 107 has been found to provide improved performance. Subsequently, the stop posts 107*a–f* are automatically and sequentially actuated and dropped to allow the cans to enter the rake zone one lane at a time. This creates fully completed groups 21** without the formation of incomplete or malformed groups.

An initial start up sequence is shown approximately one-half completed in FIG. 4. The leading or first group being formed is positioned in slot 1' between flight bars **74*d* and 74*c*. Importantly, upstream slots 0', –1', –2', . . . are clear of any incomplete groups. The group in slot 1' consists of six cans and was formed by first dropping post 107*a* immediately after downstream passage of flight bar 74*d* and allowing the forwardmost row of three cans A to be raked between it and trailing flight bar 74*c* from lane 46*a*. At this point, all downstream posts 107*b–f* were still extended and impeding the flow of cans into the selection and transport mechanism 12. Cans A' followed the trailing edge of flight bar 74*c* to form the initial row of the group being assembled in slot 2'. Stop post 107*b* dropped at the point where flight bar 74*d* passed it, thereby allowing cans B to cross dead plate 100 and to be raked into slot 1'. Also at this point, can stops 107*c–f* remained extended to hold back the cans on lanes 46*c–f*. Cans A" followed the trailing edge of flight bar 74*b* to form the initial row of the group being assembled in slot 3'. Flight bar 74*d* then progressed downstream and at the point where it passed can stop 107*c*, the stop 107*c* was retracted to allow cans C to be raked into slot 1'. Similarly, can stop 107***d* dropped upon passage of flight bar 74*d*, thereby allowing cans D to follow the trailing edge of the flight bar 74*d*. All of the stop posts 107*a–d* remain in a lowered position once initially retracted to allow continuous inflow of cans. Stop posts 107*e* and *f* are extended and halt the flow of cans E and F respectively into slots 0', –1', –2', . . . downstream of slot 1'. Can stop 107*e* will drop as soon as flight bar 74*d* passes it. As a result of this sequential process, slot 1' will contain a full and complete article group 21 once it receives cans E and F from lanes 46*d–f* exits the raking zone. Similarly, all slots 2', 3', 4 ', . . . disposed upstream of slot 1' will have complete groups. Importantly, all slots 0', –1', –2', . . . located downstream of slot 1' are clear and thereby allow automatic startup and priming of the apparatus 10. The stop posts 107*a–f* may be raised in the same sequence upon a shut down of the apparatus 10 to sequentially halt the infeed of cans to thereby create a terminal complete group with clear upstream slots on the selection and transport mechanism 12.

Referring to FIGS. 8–12, the high infeed control mechanism 99 operates in an identical manner to that of the low infeed control mechanism 98 described above. The mechanism 99 basically comprises a dead plate 145 disposed at the interface between the high article supply mechanism 14 and the article group selection and transport mechanism 12, and a plurality actuators 148*a–f* which are disposed below the deadplate 145 and have can stops 151 which are extendible through the deadplate 145 to either permit or impede movement of cans from the article supply 14 across the deadplate 145 and onto the low article groups 21 traveling on the selection and transport mechanism 12. The deadplate 145 is oriented longitudinally and parallel to the selection and transport mechanism 12. The deadplate 145 is closely spaced from each of the conveyors 61 and 73 so that the ends 47 and 86 of the guides 46 and flight bars 74, respectively, travel over its top surface. The deadplate 145 supports the bottoms of the cans 20 during the period of travel from the conveyor 61 to the divider sheets 24 disposed on top of the low groups 21. The deadplate 145 is of a similar design to that of deadplate 100, and is mounted in a similar fashion to the side plate (not shown) of conveyor 61. The actuators 148 are disposed side by side in a linear orientation and aligned longitudinally with respect to the selection and transport mechanism 12. The actuators 148 are connected to a rail 149, which is connected to frame member 150. Connection slots 158 in the rail 149 allow the positioning of the rail 149 and its connected actuators 148 to be varied with respect to the frame 150 to adjust for changes in the packaging process. Actuators 148*a*, and 148*c–f* are of an identical design to that of actuators 104*a–f*. Actuator 148*b* has a modified design to accommodate frame member 147. Frame member 147 obstructs the normal sequence of identical actuators 148 and therefore actuator 148*b* is of a different design, but it has a substantially similar function. The actuator 148*b* has an air cylinder 152, guides 153, bearing blocks 154, stops 155, a first plate 156 and a second plate 157.

As many changes are possible to the embodiments of this invention utilizing the teachings thereof, the descriptions above, and the accompanying drawings should be interpreted in the illustrative and not the limited sense.

That which is claimed is:

1. An article infeed mechanism of a packaging machine, comprising:

a) at least one article infeed line supplying a stream of articles, said article infeed line having a conveyor and a plurality of guides disposed above said conveyor and which define a plurality of article transport lanes;

b) an article group selection and transport line intersecting said article infeed line at a predetermined angle, said article group selection and transport line having a conveyor and a plurality of spaced flight bars fixed on said conveyor, said flight bars raking articles from said article infeed line to form article groups of a predetermined pattern which are transported in a linear direction by said conveyor subsequent to formation; and c) and automatic priming mechanism useable on stamp of the packaging machine to establish completed article groups on said article group selection and transport line, said automatic priming mechanism comprising:

i) a dead plate having top and bottom surfaces, said dead plate being disposed at an interface between said article infeed line conveyor and said article group selection and transport conveyor, said proximal edge of said dead plate abutting said infeed conveyor and said distal edge abutting said selection and transport conveyor, said dead plate further having a plurality of lanes located on said top surface and extending from a proximal edge to a distal edge, across which articles are moved, and at least one aperture disposed in each said lane;

ii) a plurality of stop posts, each said stop post being aligned for extension through a corresponding dead plate aperture; and iii) means to move said stop posts, whereby said stop posts are extendible and retractable above said top surface of said dead plate, said stop posts impeding travel of articles across said dead plate when extended and permitting travel of articles across said dead plate when retracted.

2. An apparatus for controlling the input of articles to a packaging machine, comprising:

a) a dead plate having top and bottom surfaces, said dead plate further having a plurality of lanes located on said top surface and extending from a proximal edge to a distal edge, across which articles are moved, and at least one aperture disposed in each said lane;

b) a plurality of stop posts, each said stop post being aligned for extension through a corresponding dead plate aperture; and c) a plurality of pneumatic actuators, each said pneumatic actuator being connected to one said stop to move said stop post, whereby said stop posts are extendible and retractable above said top surface of said dead plate, said stop posts impeding travel of articles across said dead plate when extended and permitting travel of articles across said dead plate when retracted.

3. The apparatus of claim 2, wherein said pneumatic actuators comprise a bearing block, an air cylinder connected to said bearing block and having an extendible shaft to which said stop post is connected, and means, connected to said bearing block, to guide and stabilize said air cylinder shaft.

4. The apparatus of claim 2, wherein said stop post has a rigid metallic shaft of a predetermined length, said shaft having a proximal end at which it is connected to said pneumatic actuator, and a distal end which is extendible above said dead plate top surface, said stop post further having an article contact element disposed at said distal end, said article contact element being constructed of a low friction material and having an angled top end.

5. The apparatus of claim 2, wherein said dead plate has a body constructed of a low friction material and lane defining ridges integrally formed with said body.

6. The apparatus of claim 5, wherein said low friction material is UHMW, and wherein a base constructed of a rigid metallic material is fixed to said bottom surface of said dead plate.

7. The apparatus of claim 5, wherein said dead plate apertures are disposed adjacent said proximal edge of said dead plate.

8. The apparatus of claim 5, wherein each said dead plate aperture is disposed in its respective said lane, equidistant from its respective adjacent ridges.

9. The apparatus of claim 2, wherein said stop posts are sequentially actuatable via said pneumatic actuators, whereby articles travel across said dead plate in a predetermined sequence depending upon which said lane they are disposed in.

10. The apparatus of claim 9, wherein each said stop post is initially in an extended position wherein travel of all articles across said dead plate is impeded, and wherein said stop posts are linearly, sequentially retracted to permit the articles in adjacent lanes to begin traveling across said dead plate at distinct times in a lane by lane order.

11. The apparatus of claim 2, wherein the packaging machine includes at least one article infeed line with a conveyor and a plurality of guides which define a plurality of article transport lanes, and further includes an article group selection mechanism, the infeed line being oriented to supply articles to the article group selection mechanism.

12. The apparatus of claim 11, wherein said dead plate is disposed at an interface between the article infeed line conveyor and the article group selection mechanism, said proximal edge of said dead plate abutting the conveyor and said distal edge abutting the article group selection mechanism.

13. The apparatus of claim 12, wherein the article group selection and transport mechanism has a plurality of spaced flight bars fixed on a linearly oriented conveyor, wherein the article infeed line intersects the article group selection and transport mechanism at a predetermined angle, wherein articles advance along the transport lanes of the article infeed line by the action of the conveyor, wherein articles advance across said dead plate by pressure from upstream articles being advanced by the conveyor, and wherein articles are raked from the infeed line and onto the article group selection and transport mechanism, in a predetermined group pattern, by the flight bars.

14. The apparatus of claim 13, wherein:

a) each said actuator comprises a beating block, an air cylinder connected to said bearing block and having an extendible shaft to which said stop post is connected, and memos, connected to said beating block, to guide and stabilize said air cylinder shaft;

b) said dead plate has a body constructed of a low friction material and lane defining ridges integrally formed, a base constructed of a rigid metallic material being fixed to said bottom surface of said dead plate, said dead plate apertures being disposed adjacent said proximal edge of said dead plate, and equidistant from their respective adjacent ridges; and c) said stop posts are sequentially actuatable via said means to move, whereby articles travel across said dead plate in a predetermined sequence depending upon which said lane they are disposed in, each said stop post being initially in an extended position wherein travel of all articles across said dead plate is impeded, whereby said stop posts are linearly, sequentially retracted to permit the articles in adjacent lanes to begin traveling across said dead plate at distinct times in a lane by lane order.

15. An article infeed mechanism of a packaging machine, comprising:

a) at least one article infeed line supplying a stream of articles, said article infeed line having a conveyor and a plurality of guides disposed above said conveyor and which define a plurality of article transport lanes;

b) an article group selection and transport line intersecting said article infeed line at a predetermined angle, said article group selection and transport line having a conveyor and a plurality of spaced, flight bars fixed on said conveyor, said flight bars raking articles from said article infeed line to form article groups of a predetermined pattern which are transported in a linear direction by said conveyor subsequent to formation; and c) means to prime said article group selection and transport line with completed article groups, said means to prime comprising:

i) a dead plate having top and bottom surfaces, said dead plate being disposed at an interface between said article infeed line conveyor and said article group selection and transport conveyor, said proximal edge of said dead plate abutting said infeed conveyor and said distal edge abutting said selection and transport conveyor, said dead plate further having a plurality of lanes located on said top surface and extending from a proximal edge to a distal edge, across which articles are moved, and at least one aperture disposed in each said lane;

ii) a plurality of stop posts, each said stop post being aligned for extension through a corresponding dead plate aperture; and iii) means to move said stop posts, whereby they are extendible and retractable above said top surface of said dead plate, said stop posts impeding travel of articles across said dead plate when extended and permitting travel of articles across said dead plate when retracted.

16. The apparatus of claim 15, wherein:

a) said means to move comprises a plurality of pneumatic actuators, each pneumatic actuator being connected to one said stop post, each said actuator comprising a bearing block, an air cylinder connected to said bearing block and having an extendible shaft to which said stop post is connected, and means, connected to said bearing block, to guide and stabilize said air cylinder shaft;

b) said dead plate has a body constructed of a low friction material and lane defining ridges integrally formed, a base constructed of a rigid metallic material being fixed to said bottom surface of said dead plate, said dead plate apertures being disposed adjacent said proximal edge of said dead plate, and equidistant from their respective adjacent ridges; and c) said stop posts are sequentially actuatable via said means to move, whereby articles travel across said dead plate in a predetermined sequence depending upon which said lane they are disposed in, each said stop post being initially in an extended position wherein travel of all articles across said dead plate is impeded, whereby said stop posts are linearly, sequentially retracted to permit the articles in adjacent lanes to begin traveling across said dead plate at distinct times in a lane by lane order.

17. The apparatus of claim 15, wherein said stop posts are sequentially actuatable via said means to move, whereby articles travel across said dead plate in a predetermined sequence depending upon which said lane they are disposed in.

18. The apparatus of claim 17, wherein each said stop post is initially in an extended position wherein travel of all articles across said dead plate is impeded, and wherein said stop posts are linearly, sequentially retracted to permit the articles in adjacent lanes to begin traveling across said dead plate at distinct times in a lane by lane order.

19. An apparatus for controlling the input of articles to a packaging machine, comprising:

a) a dead plate having top and bottom surfaces, said dead plate further having a plurality of lanes located on said top surface and extending from a proximal edge to a distal edge, across which articles are moved, and at least one aperture disposed in each said lane;

b) a plurality of stop posts, each said stop post being aligned for extension through a corresponding dead plate aperture; and c) means to move said stop posts, whereby said stop posts are extendible and retractable above said top surface of said dead plate, said stop posts impeding travel of articles across said dead plate when extended and permitting travel of articles across said dead plate when retracted, said stop posts being sequentially actuatable via said means to move, whereby articles travel across said dead plate in a predetermined sequence depending upon which said lane they are disposed in.

20. An apparatus for controlling the input of articles to a packaging machine, the packaging machine being of a type which includes at least one article infeed line with a conveyor and a plurality of guides which define a plurality of article transport lanes, and further includes an article group selection mechanism, the infeed line being oriented to supply articles to the article group selection mechanism, and wherein the article group selection mechanism has a plurality of spaced flight bars fixed on a linearly oriented conveyor, wherein the article infeed line intersects the article group selection mechanism at a predetermined angle, wherein articles advance along the transport lanes of the article infeed line by the action of the conveyor, and wherein articles are raked from the infeed line and onto the article group selection mechanism, in a predetermined group pattern, by the flight bars, comprising:

a) a dead plate having top and bottom surfaces, said dead plate further having a plurality of lanes located on said top surface and extending from a proximal edge to a distal edge, across which articles are moved, and at least one aperture disposed in each said lane, said dead plate being disposed at an interface between the article infeed line conveyor and the article group selection mechanism, said proximal edge of said dead plate abutting the conveyor and said distal edge abutting the article group selection mechanism, articles being advanced across said dead plate by pressure from upstream articles being advanced by the conveyor;

b) a plurality of stop posts, each said stop post being aligned for extension through a corresponding dead plate aperture; and c) means to move said stop posts, whereby said stop posts are extendible and retractable above said top surface of said dead plate, said stop posts impeding travel of articles across said dead plate when extended and permitting travel of articles across said dead plate when retracted.

21. An apparatus for controlling the input of articles to a packaging machine, comprising:

a) a dead plate having top and bottom surfaces, said dead plate further having a plurality of lanes located on said top surface and extending from a proximal edge to a distal edge, across which articles are moved, and at least one aperture disposed in each said lane;

b) a plurality of stop posts, each said stop post being aligned for extension through a corresponding dead plate aperture, said stop posts having a rigid metallic shaft of a predetermined length, said shaft having a proximal end at which it is connected to said means to move, and a distal end which is extendible above said dead plate top surface, said stop post further having an article contact element disposed at said distal end, said article contact element being constructed of a low friction material and having an angled top end; and c) means to move said stop posts, whereby said stop posts are extendible and retractable above said top surface of said dead plate, said stop posts impeding travel of articles across said dead plate when extended and permitting travel of articles across said dead plate when retracted.

22. An apparatus for controlling the input of articles to a packaging machine, comprising:

a) a dead plate having top and bottom surfaces, said dead plate further having a plurality of lanes located on said top surface and extending from a proximal edge to a distal edge, across which articles are moved, and at least one aperture disposed in each said lane, said dead plate still further having a body constructed of a low friction material and lane defining ridges integrally formed with said body;

b) a plurality of stop posts, each said stop post being aligned for extension through a corresponding dead plate aperture; and c) means to move said stop posts, whereby said stop posts are extendible and retractable above said top surface of said dead plate, said stop posts impeding travel of articles across said dead plate when extended and permitting travel of articles across said dead plate when retracted.

* * * * *